US011692790B2

(12) United States Patent
Porat

(10) Patent No.: US 11,692,790 B2
(45) Date of Patent: Jul. 4, 2023

(54) PISTOL-TO-RIFLE CONVERSION KIT

(71) Applicant: Recover Innovations Ltd., Tel Aviv (IL)

(72) Inventor: Tamir Porat, Tel Aviv (IL)

(73) Assignee: RT Recover Innovations Ltd., Tel Aviv (IL)

( * ) Notice: Subject to any disclaimer, the term of this patent is extended or adjusted under 35 U.S.C. 154(b) by 0 days.

(21) Appl. No.: 18/047,343

(22) Filed: Oct. 18, 2022

(65) Prior Publication Data

US 2023/0132043 A1 Apr. 27, 2023

(30) Foreign Application Priority Data

Oct. 21, 2021 (IL) ..... 287505

(51) Int. Cl.

| | |
|---|---|
| ***F41C 23/12*** | (2006.01) |
| ***F41A 3/66*** | (2006.01) |
| ***F41A 3/72*** | (2006.01) |
| ***F41A 19/09*** | (2006.01) |

(52) U.S. Cl.

CPC ..... *F41C 23/12* (2013.01); *F41A 3/66* (2013.01); *F41A 3/72* (2013.01); *F41A 19/09* (2013.01)

(58) Field of Classification Search

USPC ..... 42/71.02, 69.02

See application file for complete search history.

(56) References Cited

U.S. PATENT DOCUMENTS

| | | | | |
|---|---|---|---|---|
| 7,437,847 | B1 | 10/2008 | Mabry | |
| 11,573,064 | B1 * | 2/2023 | Siepman | F41C 3/00 |
| 2015/0241154 | A1 | 8/2015 | Istvanovics | |

OTHER PUBLICATIONS

European Extended Search Report, European Patent Application 22202192.5, Feb. 22, 2023.

* cited by examiner

*Primary Examiner* — Reginald S Tillman, Jr.

(74) *Attorney, Agent, or Firm* — Dekel Patent Ltd.; David Klein

(57) ABSTRACT

A pistol-to-rifle conversion kit (100) includes a rifle body (26) that includes a lower receiver (28), which includes a grip mounting portion (30), which is rearwardly adjacent to a trigger guard (32), which is rearwardly adjacent to a magazine well receiving portion (34). An auxiliary trigger (46) is sliding mounted in the rifle body (26) and includes an elongate member (48) and a forward trigger interface member (50), which extends from a forward portion of the elongate member (48) and which is configured to interface with a trigger (13) of a pistol (14) mounted in the rifle body (26), and a trigger member (56) which extends from the elongate member (48) for directly contacting a shooter's finger.

11 Claims, 5 Drawing Sheets

PISTOL-TO-RIFLE CONVERSION KIT

FIELD OF THE INVENTION

The present invention relates to firearms in general and, in particular, to a pistol-to-rifle conversion kit that converts a pistol into a rifle with the handle, trigger and magazine positioned as in an assault rifle.

BACKGROUND OF THE INVENTION

Pistol to carbine or rifle conversion kits are well known. The pistol is mounted in an assembly that has a buttstock and which essentially converts the pistol into a carbine or rifle that can be shot with the buttstock resting against the shooter's shoulder. The assembly serves as a pistol stabilizer. (The terms pistol and handgun are used interchangeably and the terms carbine and rifle are used interchangeably.)

In all known pistol-to-rifle conversion kits, the pistol is held in a rifle-like assembly. The shooter loads a magazine into the pistol and pulls the trigger of the pistol in order to shoot the pistol.

SUMMARY OF THE INVENTION

The present invention seeks to provide a novel pistol-to-rifle conversion kit that converts a pistol into a rifle with the placement of parts as in an assault rifle, as is described hereinbelow.

In all known pistol-to-rifle conversion kits, the trigger (the trigger the shooter's finger directly contacts) is forward of the magazine well (forward being defined as the direction towards the part of the weapon from which the projectile exits; rearward being defined as the direction opposite to forward and being towards the buttstock of the weapon). This is because in the prior art conversion kits, the shooter's finger directly contacts the pistol trigger and the magazine well is in the pistol handle. Contrary to the prior art, in the present invention, the conversion kit uses an auxiliary trigger rearward of and coupled to the pistol trigger. This results in a rifle which has the magazine well (the magazine well of the pistol mounted in the rifle conversion kit) adjacent and forward of the auxiliary trigger (which is the trigger the shooter's finger directly contacts), and the auxiliary trigger is adjacent and forward of the handle of the rifle. Thus, the conversion kit of the invention uniquely has the adjacent, rearward-to-forward order of handle, trigger, and magazine well on the rifle lower receiver, positioned as in an assault rifle, such as the M-16, AR-15 and AK-47. (The lower receiver of an assault rifle is the part that houses the grip (handle), trigger guard and magazine well.)

It is noted that the well-known CORNER SHOT weapon system also has an auxiliary trigger coupled to the firearm trigger. However, the present invention has different structure. In the present invention, the magazine well is adjacent the auxiliary trigger; in CORNER SHOT the magazine well is not adjacent the auxiliary trigger, and instead is on the true weapon which is on a pivoting mount (not the rifle receiver) distant from (not adjacent) the auxiliary trigger. CORNER SHOT (or prior art periscope rifle systems) does not have the adjacent, rearward-to-forward order of handle, trigger, and magazine well on the rifle lower receiver, positioned as in an assault rifle.

Thus, the conversion kit of the invention uniquely gives the shooter the exact same feel as shooting and changing magazines of an assault rifle, such as the M-16, AR-15 and AK-47.

There is thus provided in accordance with a non-limiting embodiment of the present invention a pistol-to-rifle conversion kit including a rifle body that includes a lower receiver, which includes a grip mounting portion, which is rearwardly adjacent to a trigger guard, which is rearwardly adjacent to a magazine well receiving portion, the rifle body being straight and non-pivoting from a rear buttstock mounting portion to a forward projectile exiting portion, and an auxiliary trigger sliding mounted in the rifle body and including an elongate member and a forward trigger interface member, which extends from a forward portion of the elongate member and which is configured to interface with a trigger of a pistol mounted in the rifle body, and a trigger member which extends from the elongate member for directly contacting a shooter's finger.

The forward-rearward sliding motion of the auxiliary trigger may be guided by one or more lugs received in one or more elongate holes formed in the elongate member.

The auxiliary trigger may be spring-loaded by a biasing device.

A trigger safety may be provided to either prevent or permit pulling the trigger member.

The rifle body may include two halves pivoted together about a pivot pin which is received in apertures in the halves, and one or more fasteners that secure the halves to each other.

The rifle body may include a magazine release catch.

BRIEF DESCRIPTION OF THE DRAWINGS

The present invention will be understood and appreciated more fully from the following detailed description taken in conjunction with the drawings in which:

FIGS. 4A, 4B, 4C and 4D are simplified perspective illustrations of mounting the pistol into the rifle body of the pistol-to-rifle conversion kit, in accordance with a non-limiting embodiment of the present invention, in which FIG. 4A shows opening the fasteners of the rifle body, FIG. 4B shows the rifle body opened and the pistol about to be mounted therein, FIG. 4C shows the pistol mounted in the rifle body and one of the rifle halves about to be closed, and FIG. 4D shows the pistol mounted and closed in the rifle body.

DETAILED DESCRIPTION OF EMBODIMENTS

Figure 1:
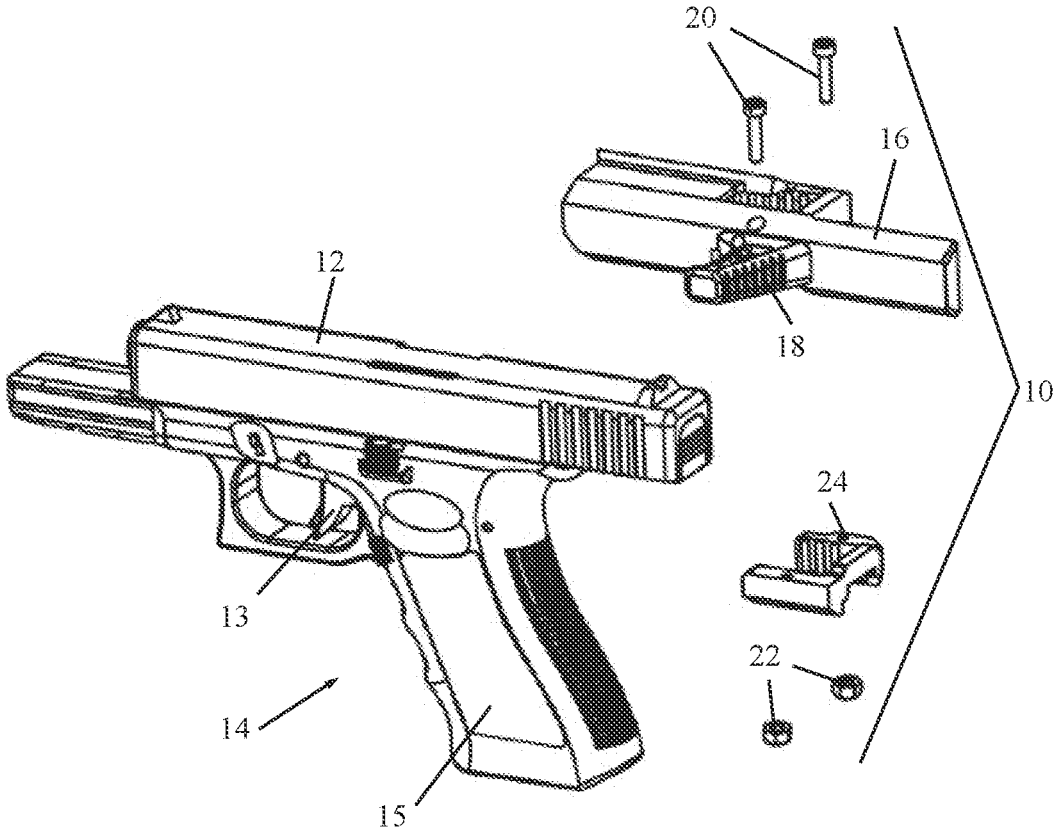
FIG. 1 is a simplified perspective, exploded illustration of a charging handle for coupling to the slide of the pistol, in accordance with a non-limiting embodiment of the present invention.

Reference is now made to FIG. 1, which illustrates a charging handle 10 for coupling to the slide 12 of a pistol 14, which has a trigger 13 and grip (handle) 15, in accordance with a non-limiting embodiment of the present invention.

The charging handle 10 may include an upper portion 16 with a side gripping handle 18. The upper portion 16 may be secured by fasteners 20 and 22 to a lower portion 24, with the upper portion 16 above the slide 12 and lower portion 24 below the slide 12. In this manner, the finished assembly of the charging handle 10 is secured to the slide 12.

It is important to note that this is just one example of coupling the charging handle 10 to the slide 12 of the pistol 14. Alternatively, the charging handle 10 may be slidingly mounted to the rifle body (described below), and when the pistol 14 is coupled to the rifle body, the charging handle becomes coupled to the slide 12, such as but not limited to, by a snap fit.

Figure 2A:
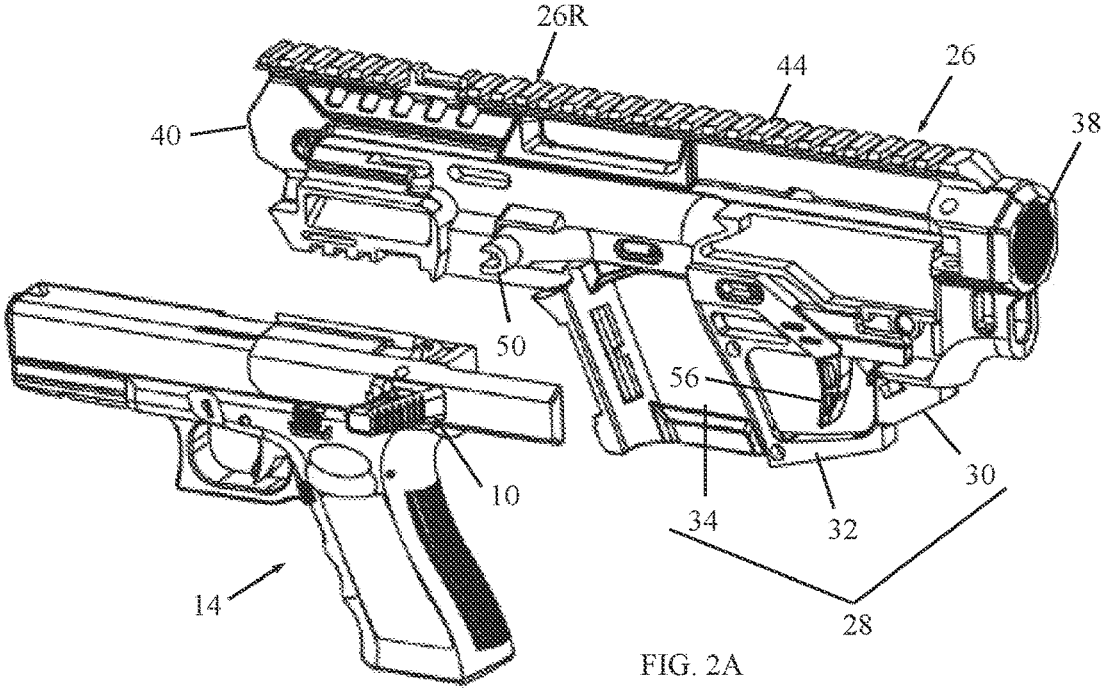
FIG. 2A is a simplified perspective illustration of the pistol about to be mounted into one half of a rifle body of the pistol-to-rifle conversion kit, in accordance with a non-limiting embodiment of the present invention.

Reference is now made to FIG. 2A, which illustrates the pistol 14 about to be mounted into one portion of a rifle body 26 of the pistol-to-rifle conversion kit. The portion shown is one half 26R of the rifle body 26 and the other half 26L is shown in FIGS. 3 and 4A-4D.

Rifle body 26 may include a lower receiver 28, which includes a grip (handle) mounting portion 30, which is rearwardly adjacent to a trigger guard 32, which is rearwardly adjacent to a magazine well receiving portion 34. A grip (handle) 36 (seen in FIG. 4A) may be fastened to the grip (handle) mounting portion 30, with a fastener (not shown), as is well known in the art.

Rifle body 26 may be straight and non-pivoting from a rear buttstock mounting portion 38 to a forward projectile exiting portion 40. A buttstock 42 (seen in FIGS. 5A and 5B) may be secured to rear buttstock mounting portion 38, such as by threaded connection or by means of fasteners, as is well known in the art.

Rifle body 26 may include at least one accessories rail 44, such as a Picatinny rail, which may extend over most or all of the length of rifle body 26 from rear buttstock mounting portion 38 to forward projectile exiting portion 40.

Figure 2B:
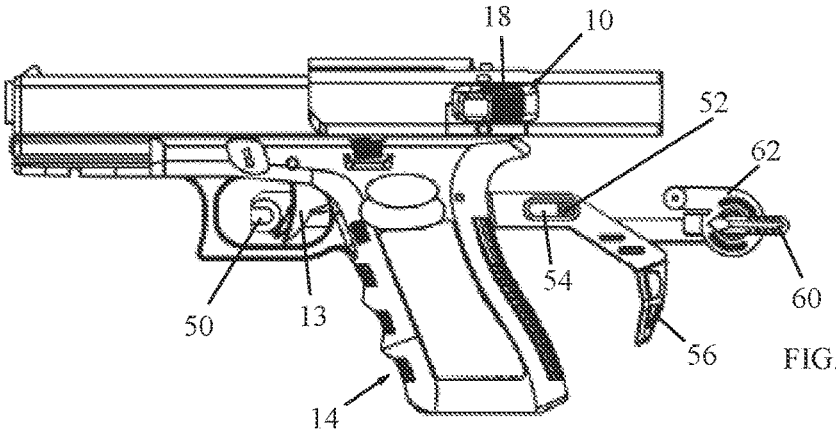
FIG. 2B is a simplified side-view illustration of the pistol coupled to the auxiliary trigger of the pistol-to-rifle conversion kit, in accordance with a non-limiting embodiment of the present invention.
Figure 2C:
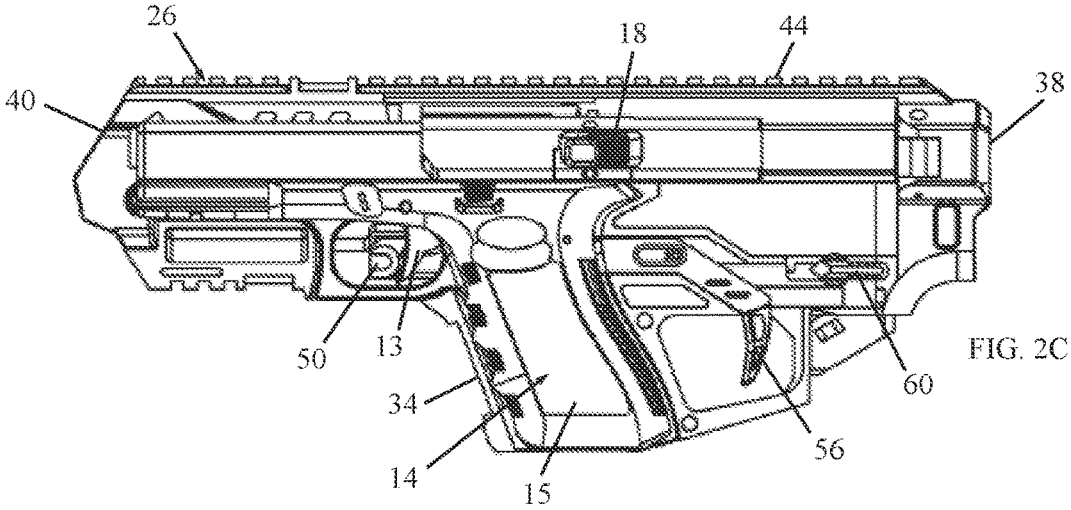
FIG. 2C is a simplified side-view illustration of the pistol mounted in the rifle body half of the pistol-to-rifle conversion kit, in accordance with a non-limiting embodiment of the present invention.
Figure 3:
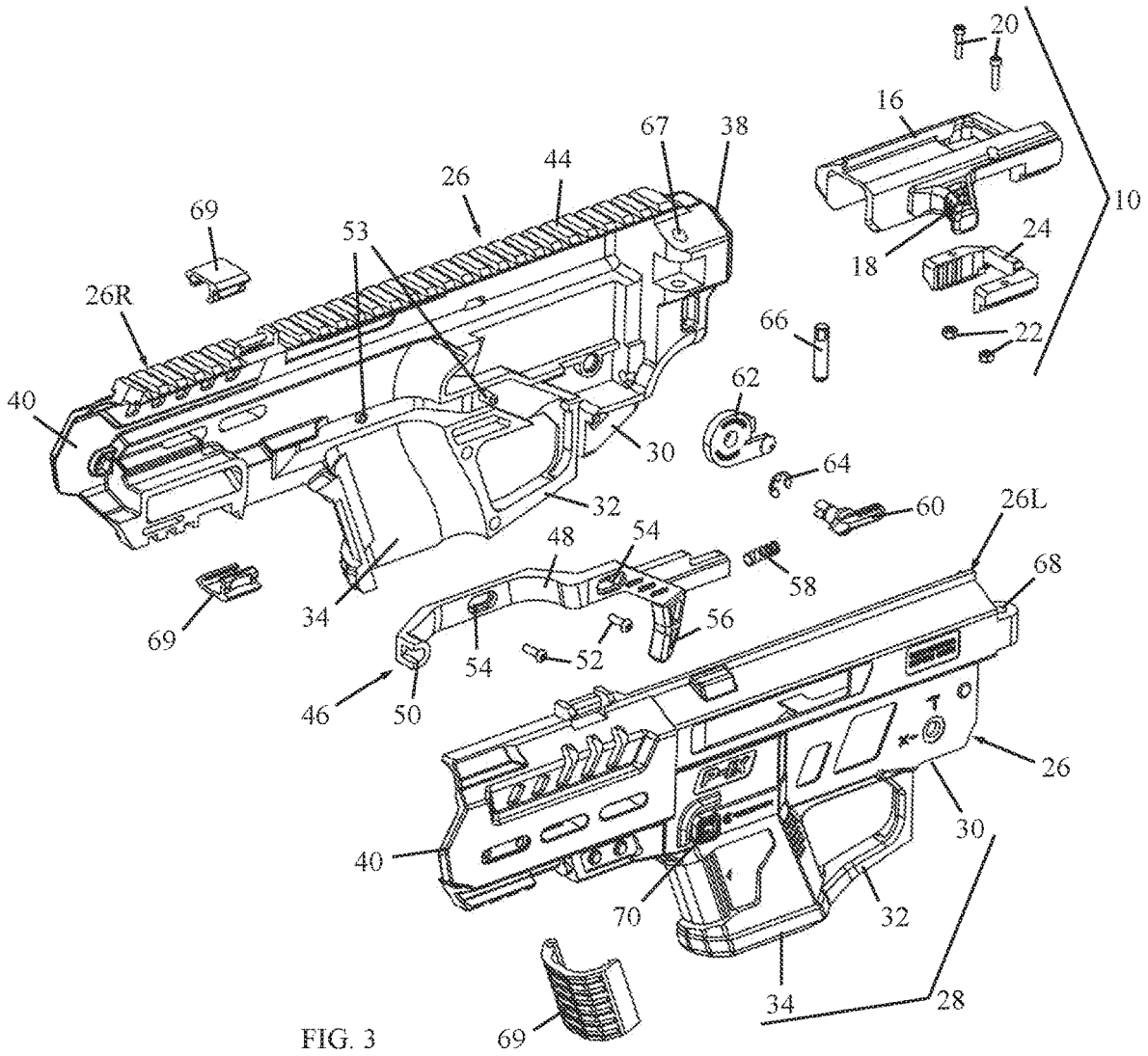
FIG. 3 is a simplified exploded illustration of the rifle body.

An auxiliary trigger 46 may be sliding mounted in rifle body 26. As seen best in FIG. 3, the auxiliary trigger 46 may include an elongate member 48 and a forward trigger interface member 50, which extends sideways from a forward portion of elongate member 48. The forward-rearward sliding motion of auxiliary trigger 46 may be guided by one or more pins, screws, or lugs 52 (secured to one or more bosses 53 of rifle body 26) which are received in one or more elongate holes 54 formed in elongate member 48. A trigger member 56 extends from elongate member 48, which the shooter's finger directly contacts. Thus, when the shooter pulls trigger member 56, the forward trigger interface member 50 pulls the trigger 13 of the pistol 14 (FIGS. 2B and 2C) to fire the pistol. The auxiliary trigger 46 may be spring-loaded by a biasing device 58.

A trigger safety 60 may be provided, which may be coupled to a cam 62, such as by a circlips 64. The trigger safety 60 resembles the safety of an assault rifle and rotation of the trigger safety 60 either prevents or permits pulling the trigger member 56.

The two halves 26R and 26L of rifle body 26 may be pivoted together about a pivot pin 66 which is received in apertures 67 and 68 in halves 26R and 26L, respectively. The halves 26R and 26L may include one or more fasteners or clasps 69 that secure the two halves to each other. In the non-limiting embodiment, there are just three clasps 69 for quick assembly.

The rifle body 26 may include a magazine release catch 70, which is aligned with the magazine catch release of the pistol, when the pistol is installed in the rifle body, so that pressing magazine release catch 70 releases a magazine from the pistol.

Reference is now made to FIGS. 4A, 4B, 4C and 4D, which illustrate mounting the pistol into the rifle body of the pistol-to-rifle conversion kit, in accordance with a non-limiting embodiment of the present invention.

Figure 4A:
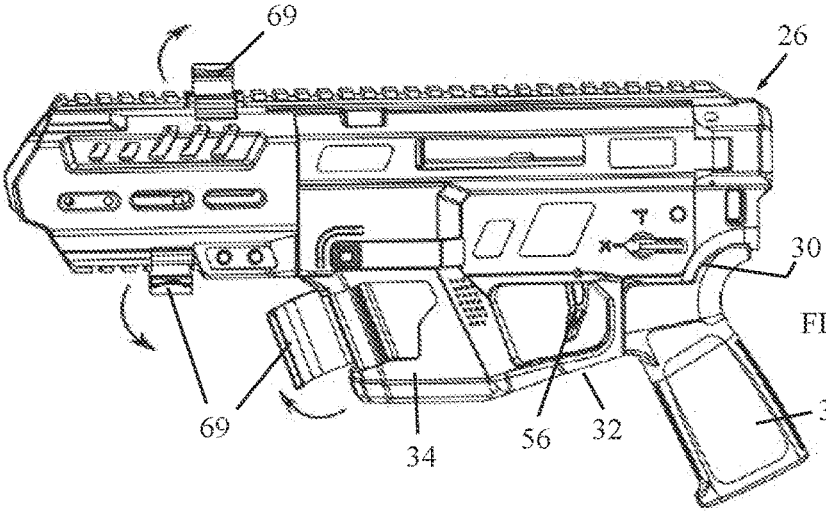
Figure 4B:
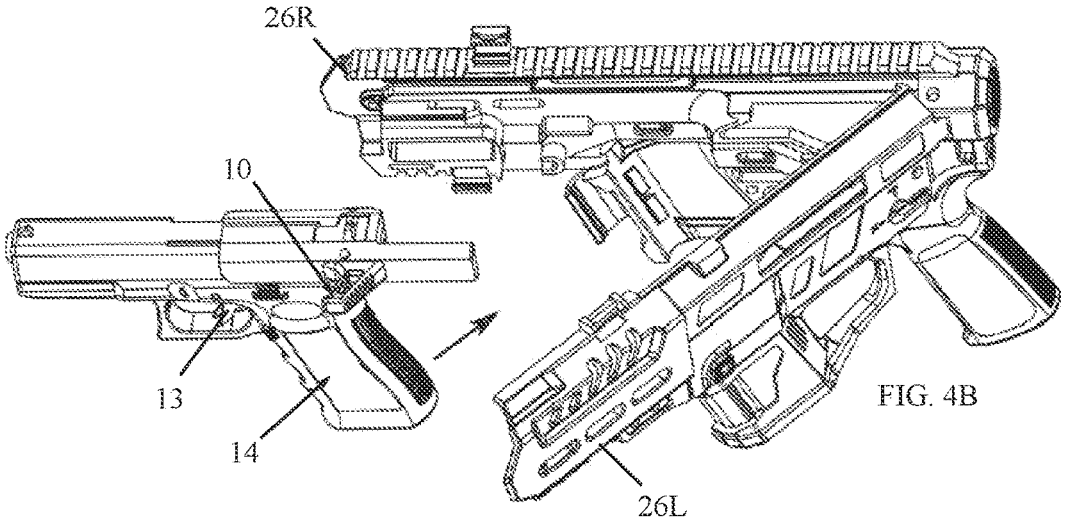
Figure 4C:
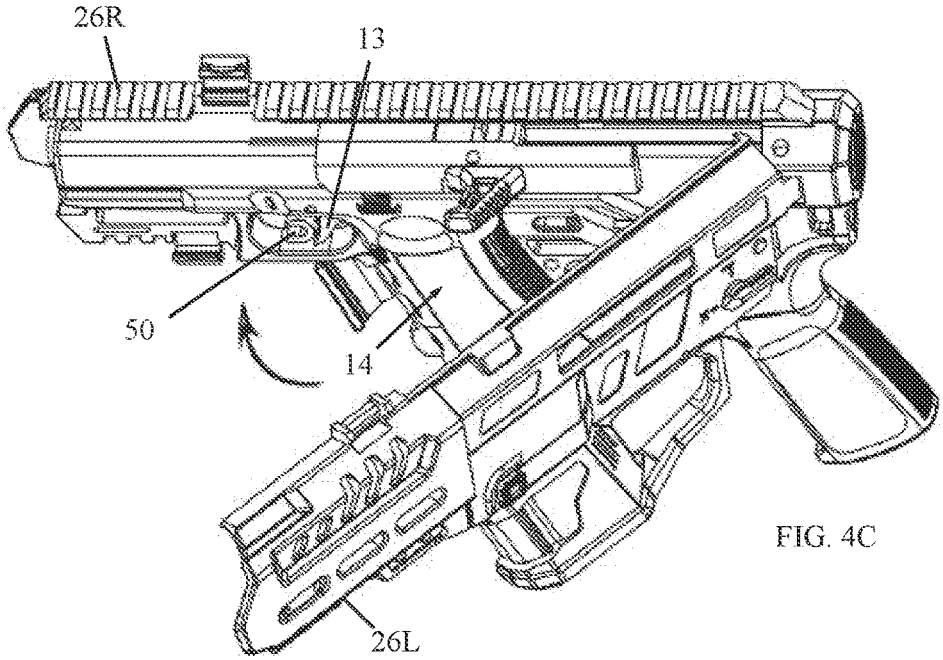
Figure 4D:
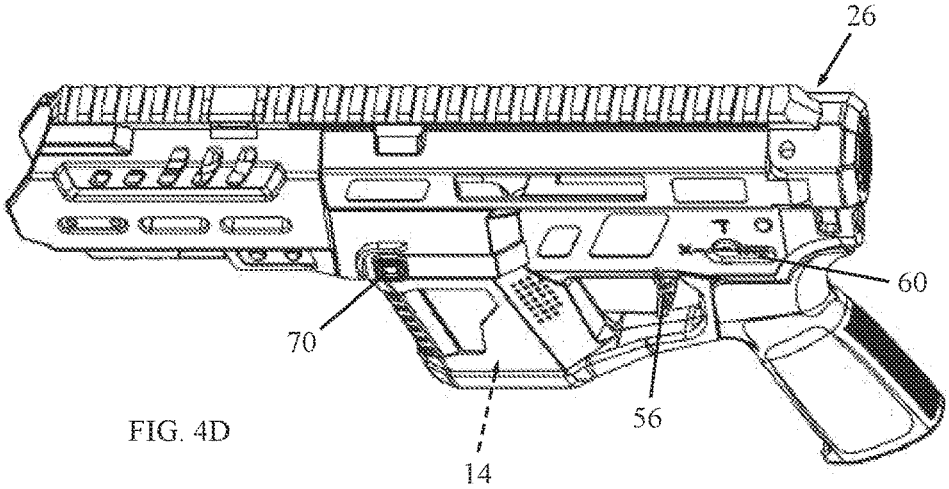

FIG. 4A shows opening the fasteners 69 of the rifle body 26. FIG. 4B shows the rifle body 26 opened (left half 26L pivoted away from right half 26R) and the pistol 14 about to be mounted therein. FIG. 4C shows the pistol 14 mounted in the rifle body 26 and the left rifle half 26L about to be closed. FIG. 4D shows the pistol mounted and closed in the rifle body 26.

Figure 5A:
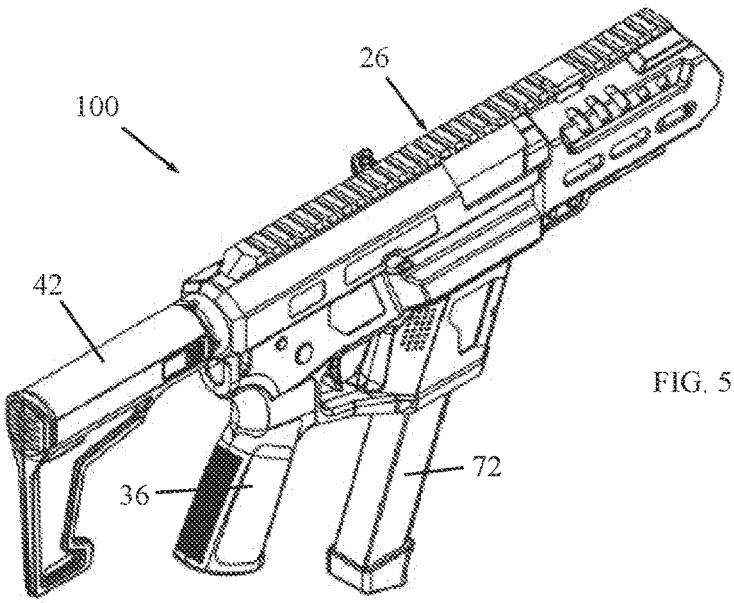
FIGS. 5A and 5B are simplified perspective and side-view illustrations, respectively, of the complete pistol-to-rifle conversion kit, in accordance with a non-limiting embodiment of the present invention.
Figure 5B:
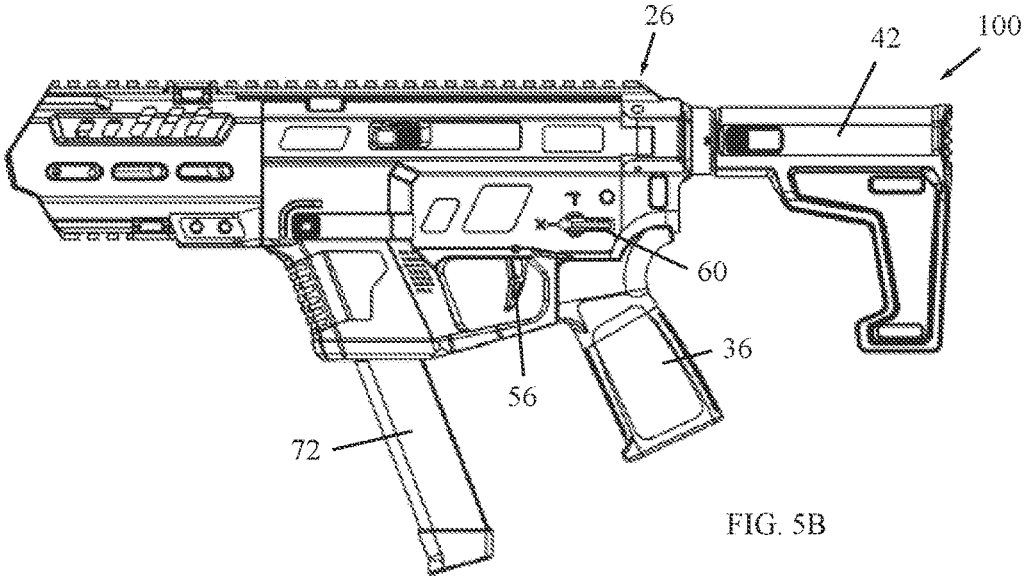

FIGS. 5A and 5B illustrate the complete pistol-to-rifle conversion kit 100, in accordance with a non-limiting embodiment of the present invention. The buttstock 42 has been secured to the assembly and a magazine 72 has been inserted in the magazine well of the pistol. The finished pistol-to-rifle conversion kit 100 looks and shoots like an assault rifle.

What is claimed is:

1. A pistol-to-rifle conversion kit (100) comprising:

a rifle body (26) that comprises a lower receiver (28), which includes a grip mounting portion (30), which is rearwardly adjacent to a trigger guard (32), which is rearwardly adjacent to a magazine well receiving portion (34), said rifle body (26) being straight and non-pivoting from a rear buttstock mounting portion (38) to a forward projectile exiting portion (40); and an auxiliary trigger (46) sliding mounted in said rifle body (26) and comprising an elongate member (48) and a forward trigger interface member (50), which extends from a forward portion of said elongate member (48) and which is configured to interface with a trigger (13) of a pistol (14) mounted in said rifle body (26), and a trigger member (56) which extends from said elongate member (48) for directly contacting a shooter's finger.

2. The pistol-to-rifle conversion kit (100) according to claim 1, wherein forward-rearward sliding motion of said auxiliary trigger (46) is guided by one or more lugs (52) received in one or more elongate holes (54) formed in said elongate member (48).

3. The pistol-to-rifle conversion kit (100) according to claim 1, wherein said auxiliary trigger (46) is spring-loaded by a biasing device (58).

4. The pistol-to-rifle conversion kit (100) according to claim 1, further comprising a trigger safety (60) configure to either prevent or permit pulling said trigger member (56).

5. The pistol-to-rifle conversion kit (100) according to claim 1, wherein said rifle body (26) comprises two halves (26R, 26L) pivoted together about a pivot pin (66) which is received in apertures (67, 68) in said halves (26R, 26L), and one or more fasteners (69) that secure said halves (26R, 26L) to each other.

6. The pistol-to-rifle conversion kit (100) according to claim 1, wherein said rifle body (26) comprises a magazine release catch (70).

7. The pistol-to-rifle conversion kit (100) according to claim 1, further comprising a grip (36) fastened to said grip mounting portion (30).

8. The pistol-to-rifle conversion kit (100) according to claim 1, further comprising a buttstock (42) secured to said rear buttstock mounting portion (38).

9. The pistol-to-rifle conversion kit (100) according to claim 1, wherein said rifle body (26) comprises at least one accessories rail (44).

10. The pistol-to-rifle conversion kit (100) according to claim 1, further comprising a charging handle (10) for coupling to a slide (12) of a pistol (14).

11. The pistol-to-rifle conversion kit (100) according to claim 1, further comprising a pistol (14) that comprises a trigger (13) and a handle (15), said pistol (14) being mounted in said rifle body (26) and said handle (15) being mounted in said magazine well receiving portion (34), and said forward trigger interface member (50) interfacing with said trigger (13) of said pistol (14) so that pulling said trigger member (56) causes said forward trigger interface member (50) to pull said trigger (13) of said pistol (14).

* * * * *